United States Patent [19]

Suga

[11] Patent Number: 4,768,711

[45] Date of Patent: Sep. 6, 1988

[54] APPARATUS FOR CHANGING ARTIFICIAL SNOW TO WET SNOW

[75] Inventor: Nagaichi Suga, Tokyo, Japan

[73] Assignee: Suga Test Instruments Co., Ltd., Tokyo, Japan

[21] Appl. No.: 6,081

[22] Filed: Jan. 23, 1987

[30] Foreign Application Priority Data

Dec. 1, 1986 [JP] Japan ..... 61-286997

[51] Int. Cl.[4] ..... A01G 15/00

[52] U.S. Cl. ..... 239/14.2

[58] Field of Search ..... 239/2.1, 2.2, 14.1, 239/14.2

[56] References Cited

U.S. PATENT DOCUMENTS

| | | | |
|---|---|---|---|
| 1,104,920 | 7/1914 | Osborne | 62/74 |
| 3,257,815 | 6/1966 | Brocoff et al. | 62/74 |
| 3,464,625 | 9/1969 | Carlsson | 239/14.2 |
| 3,733,029 | 5/1973 | Eustis et al. | 239/14.2 |
| 3,945,567 | 3/1976 | Rambach | 239/14.2 |
| 3,952,949 | 4/1976 | Dupre | 239/2.2 |
| 3,964,682 | 6/1976 | Tropeano et al. | 239/2.2 |
| 4,200,228 | 4/1980 | Woerpel | 239/2.2 |

*Primary Examiner*—Andres Kashnikow

*Assistant Examiner*—Karen B. Merritt

*Attorney, Agent, or Firm*—Wenderoth, Lind & Ponack

[57] ABSTRACT

An artificial snow making apparatus has a vertical inner cylinder having an opening at the lower end thereof, an air velocity adjusting duct connected between the top of the inner cylinder and a point near the lower end thereof and having an air blower therein for adjusting the velocity of air in the duct for thereby controlling the velocity of air inside the inner cylinder, an outer tank around the inner cylinder and having a cooling unit therein for cooling the inner cylinder and a cloud-forming vapor generator and an ice crystal seed generator connected to the inner cylinder for causing artificial snow to be generated in the inner cylinder and fall in the inner cylinder. A wet snow forming member is disposed below the opening at the lower end of the inner cylinder and directs air downwardly, and a blower draws in air, and a humidifier-heater adjusts the temperature and humidity of the drawn in air to a level higher than those of the air inside the inner cylinder to form warm and wet air, and then blows the warm and wet air into the wet snow forming member wherein it is directed downwardly to wet the snow falling through the opening from inside the inner cylinder to change the snow to wet snow.

5 Claims, 1 Drawing Sheet

APPARATUS FOR CHANGING ARTIFICIAL SNOW TO WET SNOW

BACKGROUND OF THE INVENTION

This invention relates to an apparatus for changing artificial snow made by an artificial snow making apparatus to wet snow in order to conduct a snow settling test.

One conventional artificial snow making machine is disclosed, for example, in Japanese Patent Laid-Open No. 165,566/1986 and copending U.S. patent application Ser. No. 920,194, filed Oct. 17, 1986.

This prior art technique will be described with reference to FIG. 2 of the accompanying drawings. This apparatus comprises a vertical cooling tower 4, a snow collecting chamber 1 connected to the bottom of the cooling tower 4 and having an opening 3 in the ceiling thereof which is covered by the cooling tower 4, a first cooler 9 for cooling the air inside the cooling tower 4, an inner cylinder 12 disposed inside the cooling tower 4 in such a manner as to extend in the longitudinal direction of the cooling tower 4 and having an opening at the bottom thereof which is communicated with the opening 3 of the snow collecting chamber 1, a circulation pipe 13 communicating the top to the lower end of the inner cylinder 12, a variable speed blower 14 disposed at an intermediate portion of the circulation pipe 13, a humidifier 15 for supplying moisture into the inner cylinder 12 in the proximity of the lower end of the inner cylinder 12 and a snow seed feeder for supplying ice crystals into the inner cylinder in the proximity of the humidifier 15.

No apparatus is known in the art which changes the snowfall obtained by such an artificial snow making apparatus to wet snow.

A snow-covered power transmission line undergoes torsion when it collects snow in winter and is broken from time to time. This problem occurs particularly when the snow is wet snow.

A snow settling test can be conducted at a time of snowfall in winter but wet snow is not always obtained at the time of a snowfall. Even in Hokkaido which is the northernmost part of Japan, wet snowfall can be observed only once a winter or not at all. Therefore, a snow settling test is carried out by sieving the outdoor snow to granular snow, blowing a mist at a temperature of 0° C. on the snow to wet it and causing the snow to impinge against a sample (e.g. a cable) inside an air channel to cause snow to settle thereon.

The problem here is that the properties of the snow created for such a snow settling test are entirely different from those of the natural wet snow, although the test uses the natural snow, and a reliable correlation cannot be established between them so that the snow settling test cannot be carried out accurately.

Accordingly, there is a strong demand for an apparatus for changing artificial snow to wet snow which can provide wet snow having properties almost equivalent to those of natural wet snow and which can immediately supply the wet snow thus obtained to a snow settling test.

The snow made by the conventional artificial snow making apparatus has the same crystal structure as that of the natural snow, but since the former is produced at a low temperature in the range of from about −5° C. to −15° C, its water content is low.

When formed high up in the sky, natural snow becomes the wet snow if the temperature on the ground is about 0° C. Therefore, it is possible to change the artificial snow formed in the artificial snow making apparatus and falling thereinside to wet snow by rising the temperature.

If the temperature of the snowfall chamber (test chamber) disposed at a lower part of the artificial snow making apparatus is raised in order to obtain the wet snow, however, the air in the snowfall chamber rises due to convection and air having a negative temperature inside the inner cylinder 12 falls so that the ice crystals that have not yet grown to snow also fall and the snow cannot turn to the wet snow.

For this reason, too, there is a strong demand for the development of an apparatus for changing the artificial snow to wet snow in order to carry out a snow settling test.

SUMMARY OF THE INVENTION

In order to satisfy the demand described above, the present invention provides an apparatus for changing artificial snow to wet snow by disposing a wet snow forming member below an opening at the lower end of a vertical inner cylinder for forming the snow in the artificial snow making machine to prevent the convection between the air in the vertical inner cylinder and the warm and wet air inside the wet snow forming member and to change the snow falling down inside the inner cylinder to wet snow, and the apparatus of the invention can thus make it possible to carry out a snow settling test at any arbitrary time throughout the year.

The invention will now be described in greater detail in connection with the accompanying drawings.

DETAILED DESCRIPTION OF THE INVENTION

Figure 2:
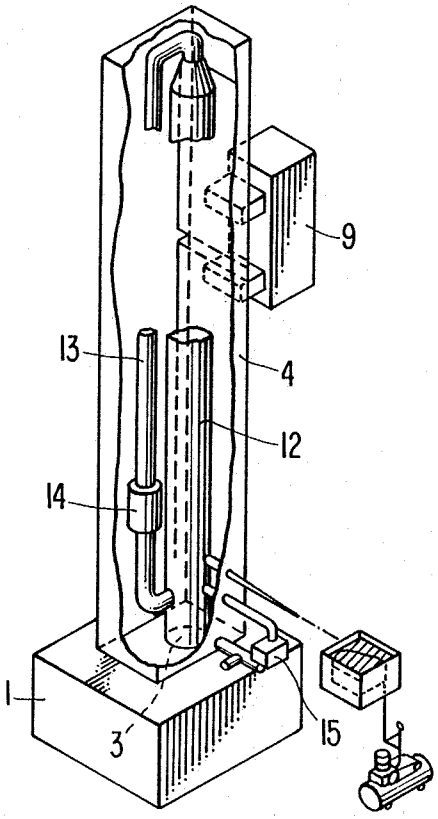
FIG. 2. (PRIOR ART)
FIG. 2 is a partially cut-away perspective view of an artificial snow making apparatus in accordance with the prior art.
Figure 1:
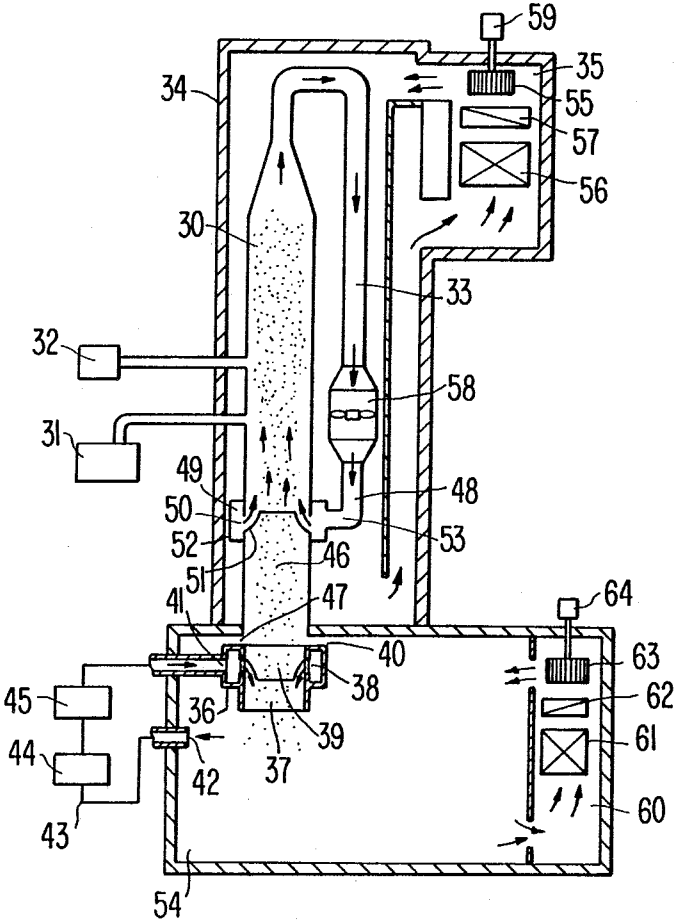
FIG. 1 is a longitudinal sectional front view of an apparatus for changing artificial snow to wet snow in accordance with the present invention.

FIG. 1 shows an artificial snow making apparatus of the type which consists of a cloud making machine 31 and a seeding device 32 that are directly connected to a vertical inner cylinder 30, an air velocity adjusting duct 33 having means therein for adjusting the velocity of the air flowing inside the inner cylinder and a cooling unit 35 disposed inside an outer tank 34 for cooling the inner cylinder. The apparatus for changing the artificial snow formed therein to wet snow according to the present invention has a wet snow forming member 36 disposed below an opening 46 at the lower end of the vertical inner cylinder 30 for forming the snow, and after air is drawn in and adjusted to a temperature and a moisture suitably higher than those of the air in the inner cylinder 30, the warm and wet air is discharged downward in order to prevent convection between the air in the inner cylinder and this warm and wet air. This warm and wet air wets the snow that descends inside the inner cylinder through the wet snow forming member 36.

The snow formed inside the inner cylinder 30 falls down inside the inner cylinder 30 and passes from an opening 46 through a snow wetting cylinder 37 of the wet snow forming member 36 disposed inside a snow collecting chamber 54.

Describing the system in somewhat more detail, the air is drawn from an outlet 42 in chamber 54 by a blower 44 and the temperature and moisture are adjusted by heater/humidifier means 45, and the air is introduced into a warm and wet air inlet 41 of the wet snow forming member 36.

The warm and wet air from the warm and wet air inlet 41 is introduced into a jacket 40 and flows in and around the jacket 40 and is discharged into the snow wetting cylinder 37 from a plurality of warm and wet air outlets 38 provided around the snow wetting cylinder 37.

The warm and wet air introduced into the snow wetting cylinder 37 impinges against a warm and wet air deflection plate 39 and is uniformly discharged downward into the snow wetting cylinder 37.

This discharge stream attracts the descending snow from above and the falling snow comes into contact with the warm and wet air and is wetted.

If a sample (e.g. a cable) is disposed below the snow wetting cylinder 37, a snow settling test can be carried out. Moreover, the snow settling test can be carried out by introducing the resulting wet snow into an air channel by a blower and causing the wet snow to impinge against the sample after accelerating it in the proximity of the outlet of the air-duct.

In the operation described above, if warm and wet air having a temperature higher than those of the air in the inner cylinder is discharged directly into the falling snow, convection occurs generally, but in the invention the convection is prevented by the deflection plate 39 which sends the warm and wet air downward. Moreover, since the descending current sucks the air downward inside the snow collecting chamber 54 from a gap 47 between the opening 46 and the upper surface of the jacket 40, convection can be prevented.

Details of a preferred embodiment of the present invention will be described with reference to FIG. 1.

The inner cylinder 30 is mounted upright over the opening 46 of the snow collecting chamber 54 and is surrounded by an outer tank 34, and the air inside this outer tank 34 is circulated by a circulation fan 55 of a cooling unit 35 and its temperature is controlled by a cooler 56 and a heater 57.

The air inside the inner cylinder 30 is circulated by a variable speed blower 58 from the upper part of the inner cylinder 30 through the air velocity adjusting duct 33 and an ascending current is applied to the air inside the inner cylinder.

The temperature inside the inner cylinder 30 is indirectly controlled by adjusting the temperature of the air inside the outer tank 34 around the outer circumference of the inner cylinder 30 and is within the range of from about −5° C. to about −20° C.

The cloud making machine 31 is connected to the interior of the inner cylinder 30 to supply a cloud-forming vapor into the inner cylinder.

The seeding device 32 is connected to the interior of the inner cylinder 30 to supply the ice crystals as the nuclei of the snow into the inner cylinder.

In the apparatus described above, the cloud and the snow from the snow seed are formed inside the inner cylinder 30 which is cooled to −15° C., for example. Here, if the speed of the ascending current is reduced, the snow grains become small and if the speed is increased, on the other hand, the snow grows to large snow grains with a weight sufficient to fall against the ascending current.

The air inside the inner cylinder turns to the ascending current from the lower part to the upper part of the inner cylinder 30 by the operation of the variable speed blower 58, and the air temperature inside the inner cylinder is indirectly adjusted and cooled by adjusting the air temperature around the outer circumference of the inner cylinder 30 as described above.

Here, the air stream blown from the variable speed blower 58 into the lower part of the inner cylinder 30 is caused to rise uniformly inside the inner cylinder by blast guide means 49 fitted to an air supply port 48.

In the blast guide means 49, reference numeral 50 designates a plurality of air discharge ports that are encompassed by a jacket 52. The air is sent from the variable speed blower 58 through an air inlet 53 in the outer circumference of the jacket 52. The air then flows around and between the inner surface of the jacket 52 and the outer circumference of the inner cylinder 30, charges the jacket 52 fully and is thereafter discharged uniformly from the plurality of air discharge ports 50.

Reference numeral 51 designates a blast direction plate having an inclined cylindrical shape, and the air charged into the inner cylinder flows along the inclined surface of this direction plate and is discharged to the upper part of the inner cylinder.

In the embodiment described above, the temperature inside the inner cylinder is adjusted to −15° C., for example, and the cloud and the seed are supplied from the portion of the inner cylinder 30 above the air blow ports 50. Furthermore, an ascending current (at a velocity of 10 cm/sec, for example) is also provided, whereby the snow is formed inside the inner cylinder 30. When the snow grows to a size that can fall against the ascending current, it starts falling inside the inner cylinder and falls into the snow collecting chamber 54 from the opening 46 at the lowermost part of the inner cylinder.

In this case, the temperature of the show collecting chamber 54 is adjusted to a level equal to, or a little lower than, the temperature inside the inner cylinder, and the snow drops under such a condition. If the temperature of the snowfall chamber 54 is higher than that of the inner cylinder, for example, convection occurs so that the snow cannot be formed inside the inner cylinder and the ice crystals fall instead.

The apparatus for wetting the snow consists of the wet snow forming member 36, the heater/humidifier means 45, the blower 44 and the circulation pipe 43 connecting them to one another.

The wet snow forming member 36 is disposed below the opening 46 of the inner cylinder 30 and concentrically with the inner cylinder 30. It includes the warm and wet air discharge ports 38, the warm and wet air deflection plate 39 disposed inside the discharge ports 38, the jacket 40 surrounding the discharge ports 38 from outside, and the warm and wet air inlet 41 for charging the warm and wet air into the jacket 40.

The deflection plate 39 has an inclined cylindrical shape and exhibits the function of discharging the air downwards uniformly onto the inner surface of the snow wetting cylinder 37.

The air drawn by the blower 44 is from the air inlet 42 in the wall of the snow collecting chamber 54 and is sent through the circulation pipe 43 to the heater/humidifier means 45, where the temperature and moisture is adjusted to be suitably higher than those of the air of the inner cylinder by the heater and the humidifier, and is then supplied to the wet snow forming member 36.

The wet snow forming member 36, the heater/-humidifier means 45, the blower 44 and the air inlet 42 are communicated with one another by the circulation pipe 43 so as to circulate the air.

The gap 47 is defined between the opening 46 at the lower part of the inner cylinder 30 of the artificial snow making apparatus and the wet snow forming member 36, and the air inside the snow collecting chamber 54 flows into the snow wetting cylinder 37 through this gap 47.

This is because the warm and wet air blown into the snow wetting cylinder 37 turns to a descending current due to the operation of the deflection plate 39, and the air inside the snow collecting chamber 54 is drawn by this descending current and flows into the snow wetting cylinder 37 through the gap 47, thereby preventing convection into the air inside the inner cylinder 30.

A plurality of air vents may be formed at the upper end of the wet snow forming member in place of the gap 46 to obtain the same effect as described above.

In the drawing, reference numeral 59 designates a fan motor for rotating the circulation fan 55, and 60 a cooling unit disposed in the snow collecting chamber and includes a cooler 61, a heater 62, a circulation fan 63 and a fan motor 64.

Since the present invention has the construction described above, convection between the air in the inner cylinder of the artificial snow making apparatus and the air inside the snow collecting chamber is prevented, and the snow that descends inside the inner cylinder is wetted and then introduced into the snow collecting chamber. Accordingly, a snow settling test can be carried out at an arbitrary time throughout the year.

As a result, the snow settling test can be conducted easily by disposing a sample (such as a cable) below the snow wetting cylinder, or by introducing the resulting wet snow into an air-duct by a blower, accelerating the wet snow and causing it to impinge against the sample mounted near the outlet of the air-duct.

Since the snow wetted in accordance with the present invention has the same properties as those of the natural wet snow, it has a close correlation with the natural wet snow and the snow settling test can be made accurately.

Accordingly, the present invention contributes greatly to the clarification of the settling of the snow on power transmission lines, the development of a method of preventing the settlement of the snow and the development of covering materials for the cable. The present invention can also be used for clarifying the settlement of the snow and preventing snow damage on roof materials, air planes, cars, and so forth.

What is claimed is:

1. An artificial snow making apparatus comprising:

a vertical inner cylinder having an opening at the lower end thereof;

an air velocity adjusting duct connected between the top of said inner cylinder and a point near the lower end thereof and having an air blower means therein for adjusting the velocity of air in said duct for thereby controlling the velocity of air inside said inner cylinder;

an outer tank around said inner cylinder and having a cooling unit therein for cooling said inner cylinder;

a cloud-forming vapor generator and an ice crystal seed generator connected to said inner cylinder above said point at which the lower end of said air velocity adjusting duct is connected to said inner cylinder, whereby artificial snow is generated in said inner cylinder and falls in said inner cylinder;

means for changing the artificial snow generated in said inner cylinder into wet snow and having a wet snow forming member disposed below the opening at the lower end of said inner cylinder and including means for directing air downwardly, means for drawing in air, means for adjusting the temperature and humidity of the drawn in air to a level higher than those of the air inside said inner cylinder to form warm and wet air, and then blowing the warm and wet air into said wet snow forming member wherein it is directed downwardly to wet the snow falling through said opening from inside said inner cylinder to change the snow to wet snow.

2. An apparatus as claimed in claim 1 in which said wet snow forming member comprises a snow wetting cylinder having a central opening therethrough just below said opening from said inner cylinder for receiving the snow falling in said inner cylinder, said snow wetting cylinder having a warm and wet air discharge port around the upper part of said snow wetting cylinder and directed into said central opening, and a warm and wet air deflection plate on the inside of said snow wetting cylinder inside said discharge port in the path of air discharged from said discharge port, a jacket around the outside of said snow wetting cylinder encompassing said discharge port, and a warm and wet air receiving port in said jacket for receiving the warm and wet air into said jacket.

3. An apparatus as claimed in claim 1 further comprising a snow collecting chamber below said inner cylinder into which the opening at the lower end of said inner cylinder opens, said set snow forming member being positioned in said snow collecting chamber, and said means for drawing in air is connected to said snow collecting chamber.

4. An apparatus as claimed in claim 1 in which said set snow forming member is spaced below said opening from said inner cylinder to define a gap between the lower end of said inner cylinder and said wet snow forming member.

5. An apparatus as claimed in claim 1 further comprising an air blast guide means in said inner cylinder comprising a jacket around said inner cylinder at the point on said inner cylinder where said lower end of said air velocity adjusting duct is connected to said inner cylinder and into which said air velocity adjusting duct opens, said inner cylinder having air vents around the periphery thereof opening thereinto from inside of said jacket, and a direction plate around the inside of said inner cylinder inside said air vents and directed upwardly for directing the air from the air vents upwardly in said inner cylinder.

* * * * *